United States Patent [19]

Corl et al.

[11] Patent Number: 4,870,394

[45] Date of Patent: Sep. 26, 1989

[54] SMOKE DETECTOR WITH IMPROVED TESTING

[75] Inventors: John L. Corl, El Sobrante; Gregory S. Triplett, Richmond, both of Calif.

[73] Assignee: Systron-Donner Corp., Concord, Calif.

[21] Appl. No.: 149,423

[22] Filed: Jan. 29, 1988

[51] Int. Cl.[4] ..... G08B 17/10; G08B 29/00

[52] U.S. Cl. ..... 340/630; 340/514; 340/945

[58] Field of Search ..... 340/630, 945, 514

[56] References Cited

U.S. PATENT DOCUMENTS 3,983,548 9/1976 Tufts ..... 340/514

4,065,759 12/1977 Handing ..... 340/630

4,642,615 2/1987 Suzuki ..... 340/630

4,749,871 6/1988 Galvin et al. ..... 340/630

*Primary Examiner*—Glen R. Swann, III

*Attorney, Agent, or Firm*—Flehr, Hohbach, Test, Albritton & Herbert

[57] ABSTRACT

A light scatter smoke detector includes an infrared light source and light sensor in a smoke chamber, the chamber including an adjustable screw which serves as a scatter reflector to provide an operating voltage used both in normal operation and for testing. A dual channel is also provided by a splitting off some light from the light source into a separate reference channel which is also used for threshold detection or proper ratioing.

12 Claims, 5 Drawing Sheets

SMOKE DETECTOR WITH IMPROVED TESTING

FIELD OF INVENTION

The present invention relates to a smoke detector system and more specifically, a system using a light scatter technique.

DESCRIPTION OF PRIOR ART:

In a typical light scatter smoke detector system there is a smoke chamber; then, within the chamber there is a light source with a light beam path and a light sensor. The light sensor detects light scattered from the beam path by smoke particles within the chamber. When a threshhold level is passed, an alarm signal is produced. The light sensor is positioned so it acts, for example, oblique (in other words, there's no direct path) from the light source. Such a detector and in fact one in which a similar construction is used, as far as the chamber and light source and detector or sensor, is disclosed in a co-pending U.S. application, Serial No. 860,567 filed May 1986 and now U.S. Pat. No. 4,728,801 (also published as British application No. 2170597 Aug. 6, 1986 .

Since smoke detectors of the above type are utilized in, for example, the cargo bays of airplanes, they must be reliable and there should be a system for continually testing the smoke detectors throughout their lives. One present technique of testing, in fact used by the detector as discussed above, is to provide an aperture in the detector itself where insertion of a rod simulates smoke to test whether the alarm will be activated. This is a rather simple type of test and may be difficult to implement depending on the location of the smoke detector.

OBJECTS AND SUMMARY OF INVENTION

It is therefore a general object of the present invention to provide an improved smoke detector.

In accordance with the above object, there is provided a light scatter smoke detector system having a light source with a light beam path and a light sensor, both positioned within a chamber to detect light scattered from the beam path by smoke particles within the chamber, and thereby produce an alarm signal. The light sensor in accordance with standard light scatter technique is positioned away from the beam path of the light source. The system comprises light reflector means proximate to the beam path for reflecting light to the light sensor. Threshhold means are responsive to the light sensor for suppressing an alarm signal when only reflected light of the light reflector means is received by the light sensor.

In addition, there is a method for adjusting parameters of this system to make it more effective for testing and for alarm purposes.

Figure 1:
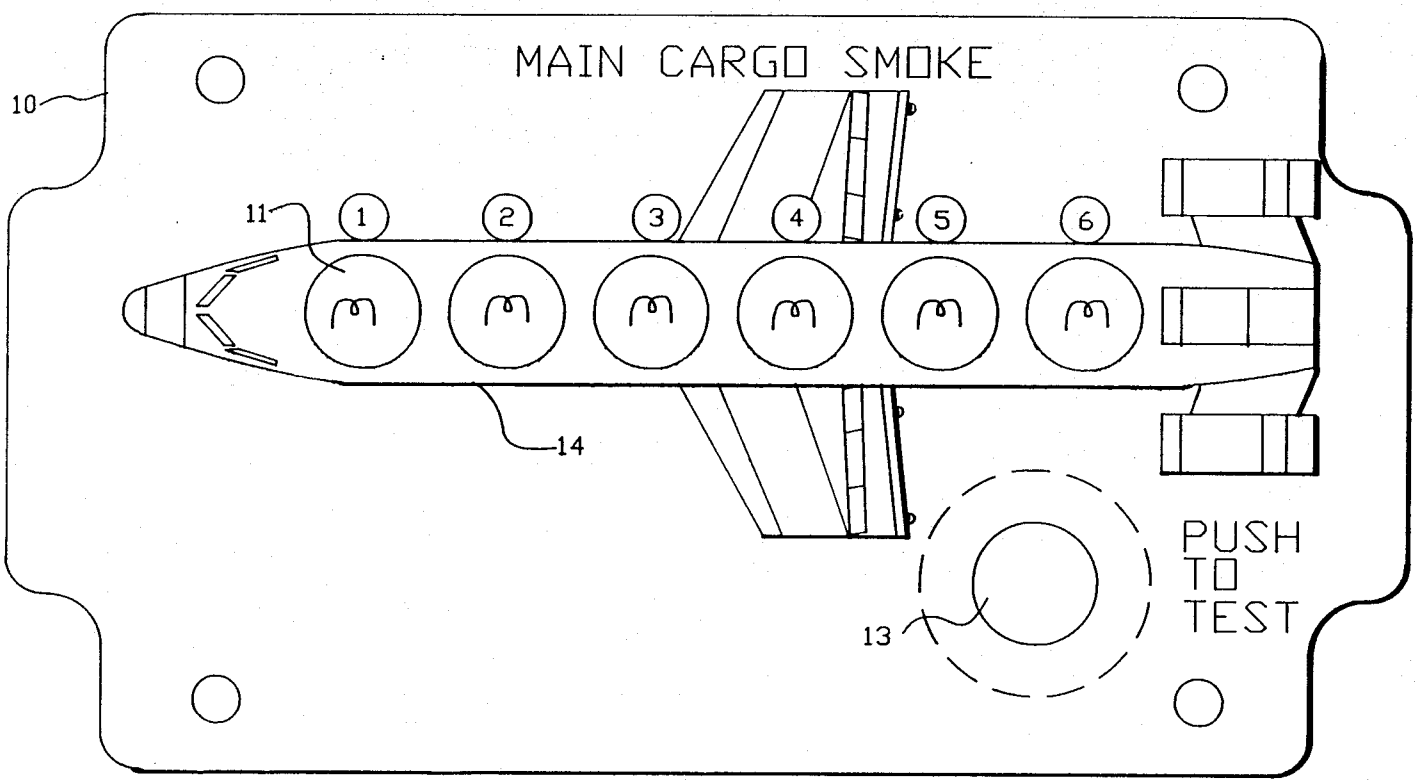
FIG. 1 is a view of a control panel located remotely from the remainder of the smoke detector of the present invention for displaying smoke alarm conditions and for initiating a test.

DESCRIPTION OF THE PREFERRED EMBODIMENT:

FIG. 1 illustrates the face plate 10 which, along with the associated lights 11 and push to test switch 13, would be located in the cockpit of, for example, an airplane. In one use, the smoke detector system of the present invention would have several smoke detectors mounted in the cargo bay of an aircraft with the outline of the airplane indicated at 14, in the various six locations so numbered. Each unit is associated with a warning light 11 or alarm light. If any light is illuminated, this indicates sufficient smoke sensed by the detector to indicate that smoke is present; viz, an alarm.

When push to-test-button 13 is actuated (which is of course quite remote from the actual smoke detectors in the cargo bay), if the smoke detector is operating in a normal functioning mode, each light 11 will be on in a steady condition. If a light does not go on, it indicates a fault in that particular smoke detector; finally, if there is a blinking light (specifically at a 5 Hz rate), this is a marginal or "maintenance required" condition. This means that this system is still functional but must be repaired or maintained in the near future.

Figure 2:
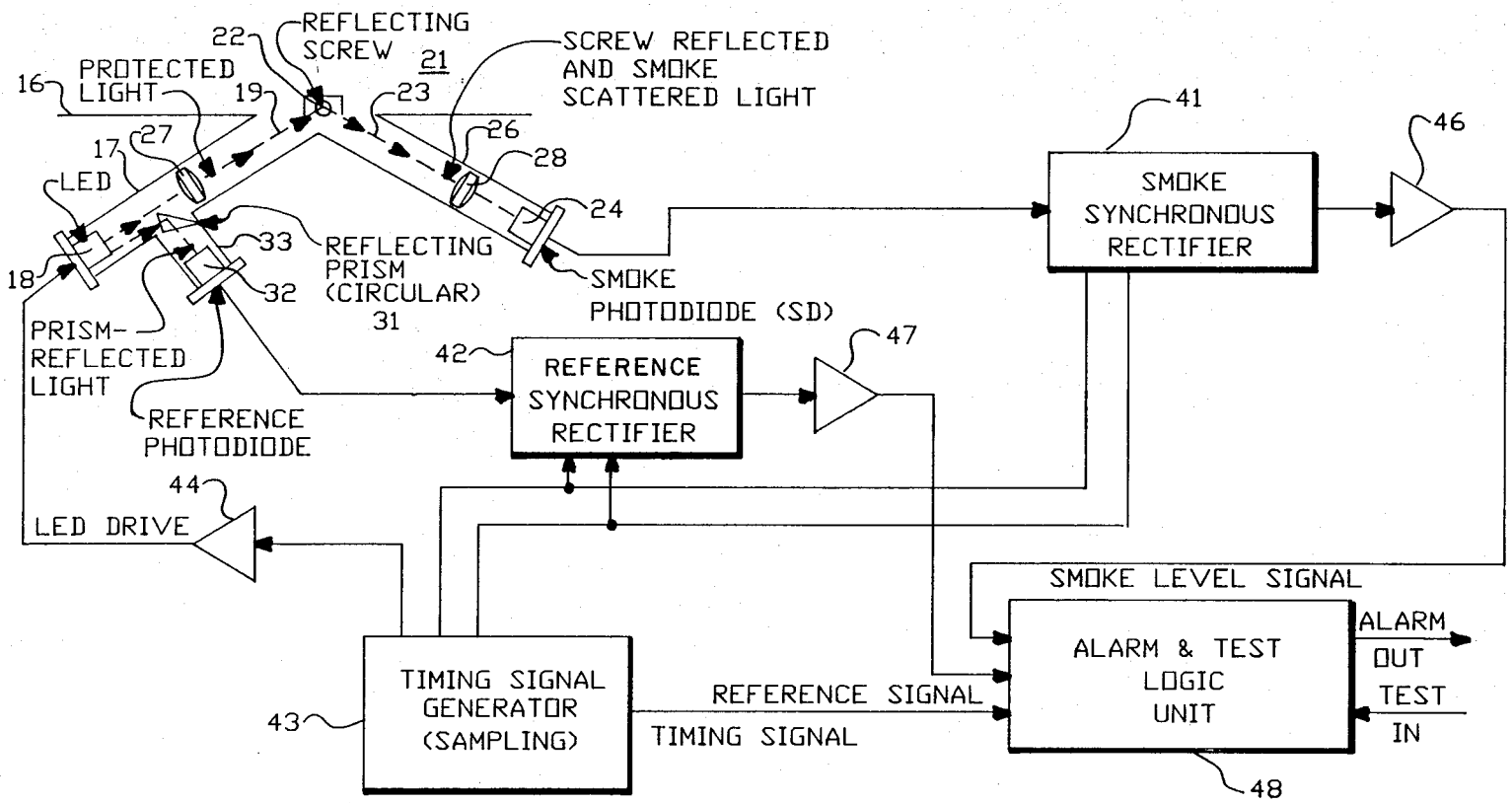
FIG. 2 is a block diagram, along with a simplified cross-sectional view of the mechanical portions of the smoke detector system, embodying the present invention.

The main mechanical elements of a typical smoke detector—one with the associated electrical system in block diagram—is illustrated in FIG. 2. A base or light array section 16 of the smoke detector includes an integral channel 17 which contains a light source in the form of a light emitting diode 18 which projects light along the axis 19. This light is projected into the smoke chamber generally indicated at 21. Axis 19 is intercepted by a reflecting screw 22. Screw-reflected and smoke-scattered light along the axis 23 is sensed by a smoke channel photodiode 24 which is located at the end of an integral channel 26 of the base 16. An appropriate lens 27 is provided for the light source 18 and a lens 28 in the smoke channel for this photodiode 24. By the use of a circular reflecting prism 31 in the channel 17, a small fraction of light from LED 18 is reflected or diverted to a reference photodiode 32 located in a perpendicular channel 33 of base 16.

Figure 3:
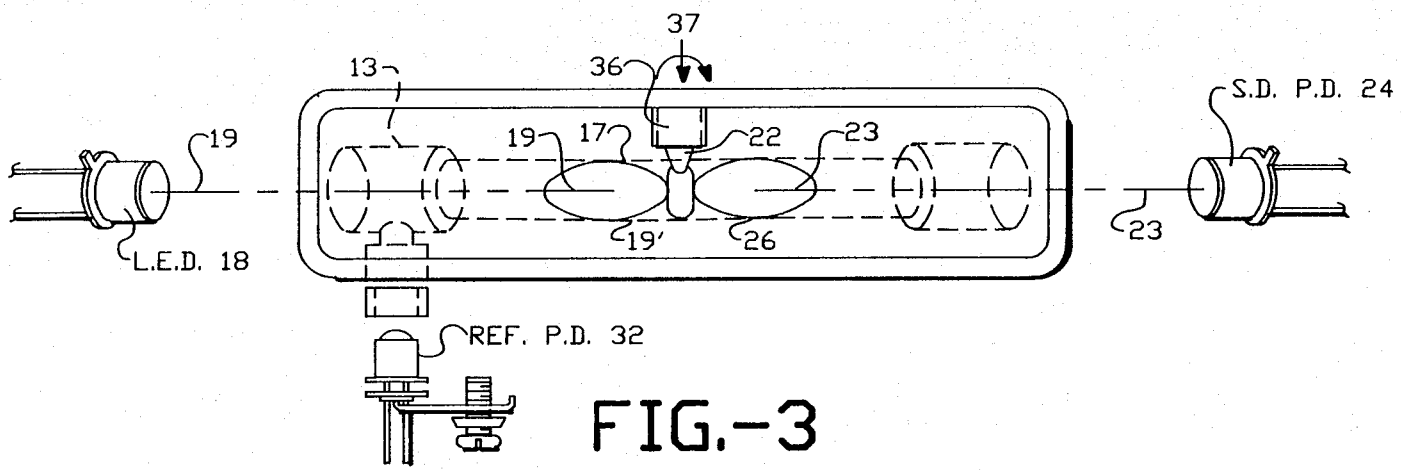
FIG. 3 is a more detailed top view of the mechanical portion of FIG. 2.
Figure 4:
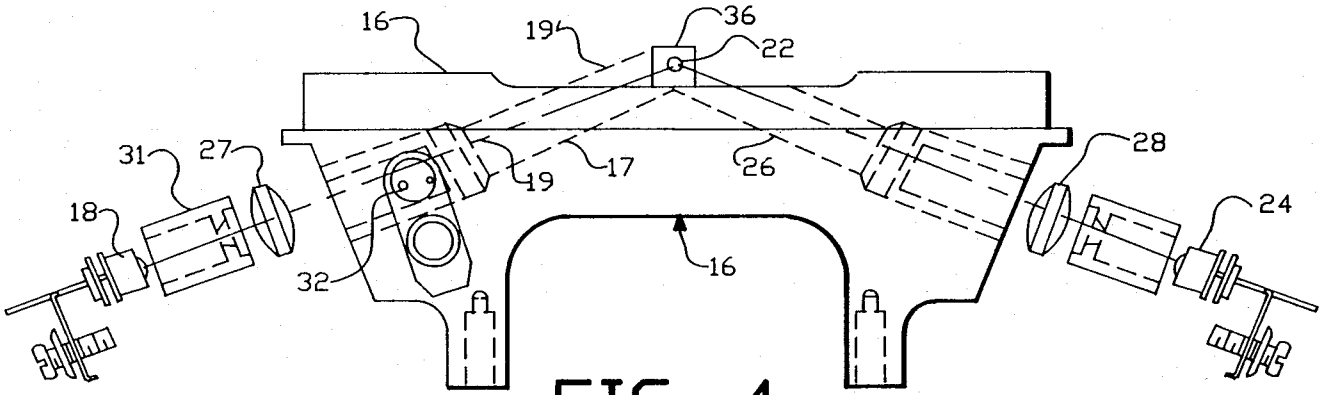
FIG. 4 is a side view of FIG. 3.

Referring briefly to FIGS. 3 and 4, the foregoing is shown in greater detail. The light-reflecting screw 22 is actually in close proximity to the beam path 19' surrounding axis 19 of light source 18. The screw is mounted on a block 36 mounted on base 16 and is adjustable by an insertion of, for example, a screwdriver as indicated by the arrow 37. The tip of screw 22 extends slightly into the beam path 19' to deflect a small portion of light into the smoke detector photodiode 24. This provides for an initial setup and for the test function, as will be described below.

Referring back to the circuit block diagram portion of FIG. 2, synchronous rectifiers 41 and 42 receive the signal outputs of the smoke and reference channels respectively. They are controlled by a timing signal generator 43 which operates the system on a pulse type of sampling basis in a manner well known in the art. The timing signal generator also drives the LED drive unit 44 which is connected to LED 18. The outputs of rectifiers 41 and 42, after being amplified at 46 and 47, are processed by an alarm and test logic unit 48. The synchronous rectifiers and pulsed light source are used to reduce the influence of stray light, steady or flashing. Logic unit 48, to be discussed below in detail, provides an "alarm out" channel which drives the alarm lights 11, illustrated in FIG. 1, and a "test in" channel which is actuated and electrically connected to the test push button 13 of FIG. 1.

Figure 5:
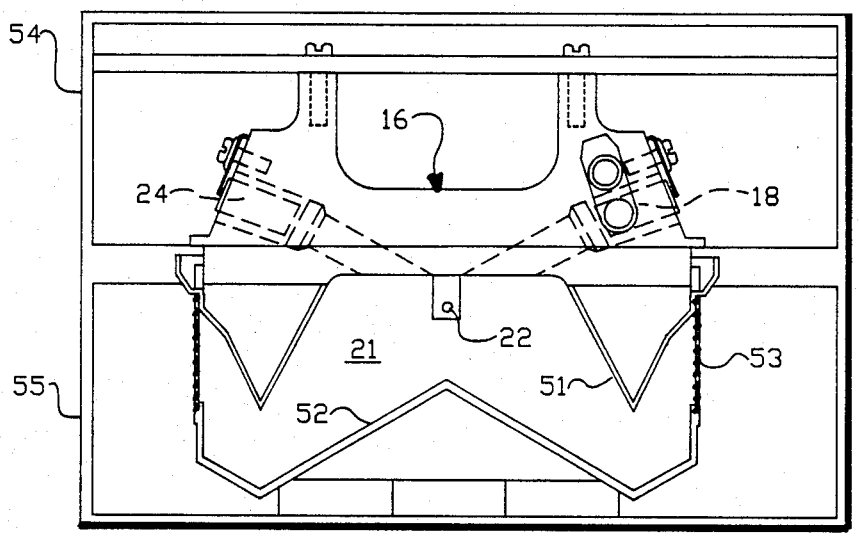
FIG. 5 is a simplified cross-sectional view of the overall mechanical portions of the smoke detector system, including the portions of FIGS. 3 and 4, in assembled format.

FIG. 5 illustrates the mechanical portion of the smoke detector unit in assembled form as it would be, for example, suspended in a cargo bay of an airplane. The base or light array portion 16 of course includes the light source 18 and the smoke detecting photodiode 24. The axes of the light source and sensor intersect at the reflecting pin 22 which is located in the smoke chamber 21.

Such chamber is formed by an element 51 which has a surface corresponding to the exterior of a cone. This surface mates with a frusto-conical surface type element 52 which has as its terminating end a cylindrical wire mesh 53 to allow the passage of smoke. The surfaces of portions 51 and 52 are polished black to promote spectral energy reflection. In general, a stream of air flows through the detector and is monitored in the chamber 21 for the presence of smoke particles by the sensor 24 watching for light which originated from the source and which is scattered by smoke particles in the chamber causing light to arrive at the sensor 24. In general, details of the foregoing chamber and operation thus far described are discussed in the above patent 4,728,801.

The entire apparatus is enclosed by suitable covers 54 and 55 with enclosure 55 being either apertured for free convection or fitted with pipes for a draw-through configuration.

Figure 6:
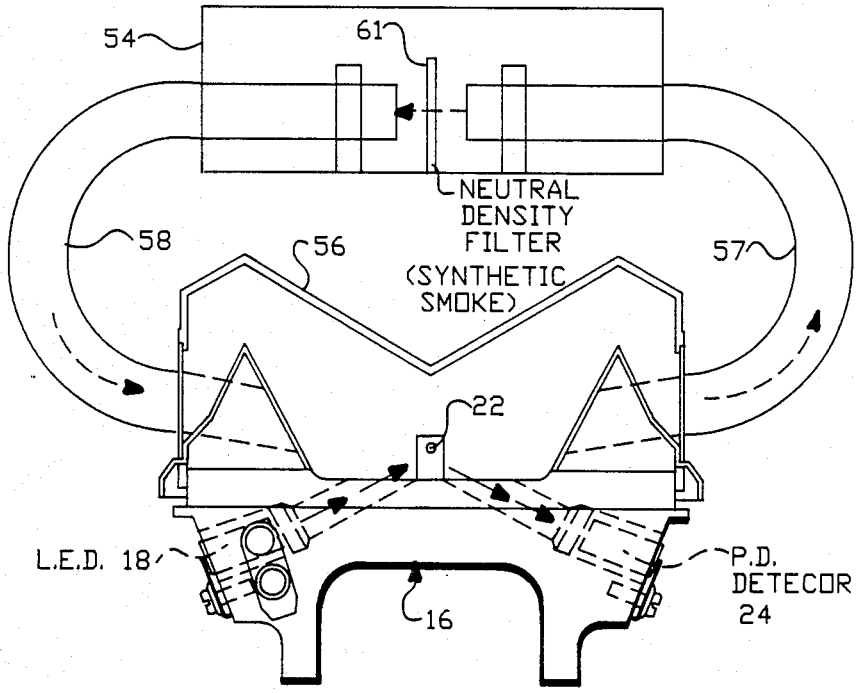
FIG. 6 is a simplified elevation view of a synthetic smoke apparatus used during the set-up of the system of the present invention.

For initial factory calibration and testing, enclosure 55 and portions 51 and 52 are all removed and a synthetic smoke fixture is fitted on top of the base 16, as illustrated in FIG. 6. The fixture includes a labyrinth base 56 (which duplicates chamber 21) with a first fiber optic light guide 57 receiving light from the light source 18 and a second fiber optic guide 58 retransmitting said light back to the photodiode or light sensor 24, as indicated by the arrows. A secondary fixture 59 juxtaposes the ends of the fiber optic elements 57 and 58 through a neutral density filter 61. The effect of this is to simulate smoke as it might actually be detected by photodiode detector 24 and at the approximate signal level. Alternatively an Underwriters Laboratory (UL) 268 type apparatus can be used to provide a desired level of "smoke" in chamber 21.

Figures 7, 7A:
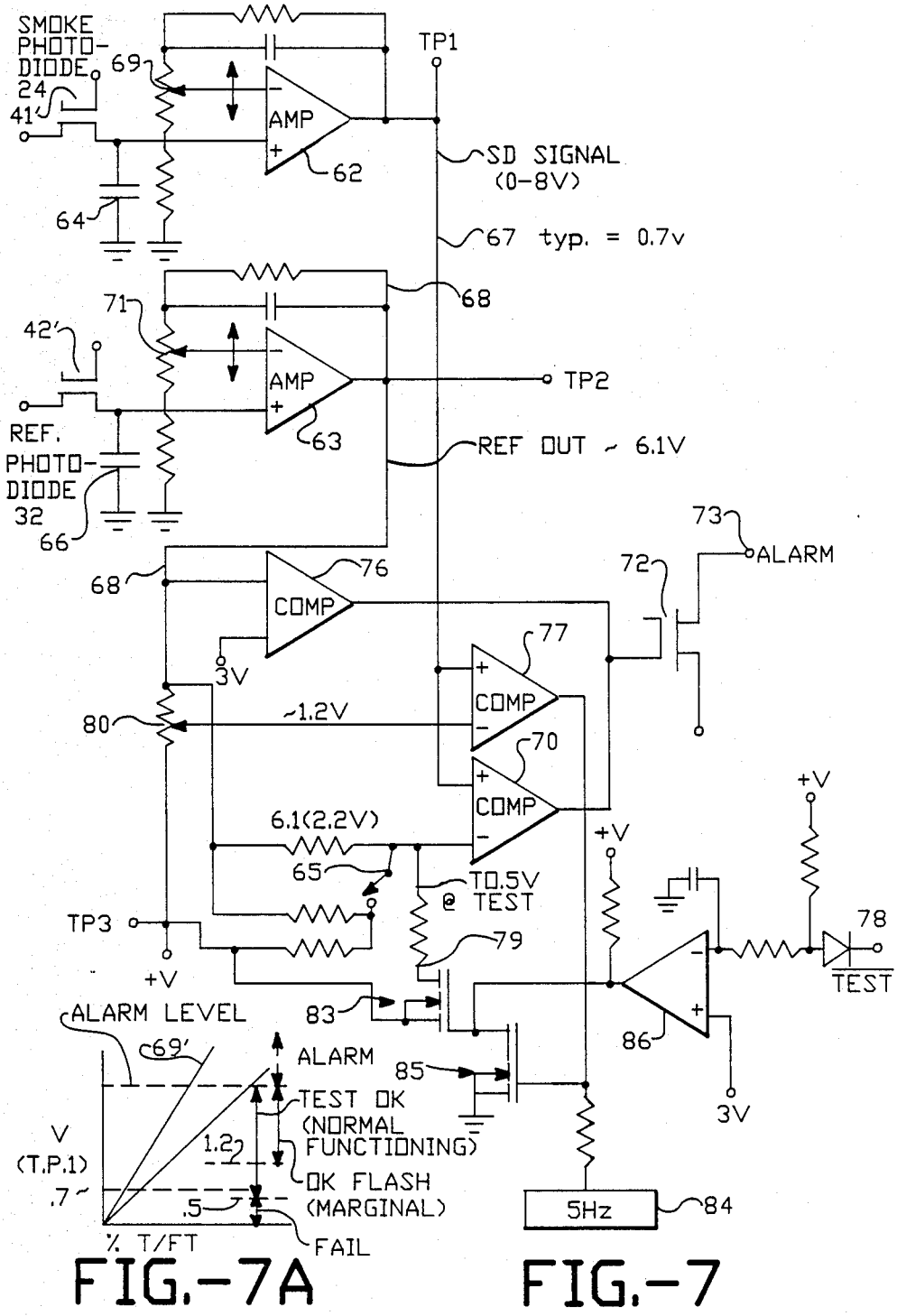
FIG. 7 is a detailed circuit schematic embodying the present invention.
FIG. 7A is a graph useful in understanding the circuit of FIG. 7 and in general the overall functioning of the present invention.

FIG. 7 illustrates details of the electrical circuitry illustrated in block diagram in FIG. 2. Signals from smoke photodiode 24 and reference photodiode 32 are connected to variable gain amplifiers 62 and 63. These input signals in effect are synchronously demodulated DC signals as produced by the combination of the FETs 41' and 42' and the associated capacitors 64 and 66. Thus the voltage applied to amplifiers 62 and 63 is actually a DC output voltage which is proportional to the amount of light projected into the smoke space (the reference channel) and the amount scattered by the smoke (the smoke channel). At the output of amplifier 62 is a smoke signal on the line 67 and amplifier 63 a reference signal on the line 68 also designated with the test point indications TP1 and TP2, respectively. Smoke amplifier 62 compares the input 24 with a variable negative input, as shown by the variable resistance 69 to provide a variable gain. Similarly, amplifier 63, the reference amplifier, has a negative input provided by the variable resistance 71.

The smoke signal on output line 67 will range from 0 to 8 volts (with reference to TP3) and is typically 0.7 volts (ratio = 0.115) during normal non-smoke detection conditions; when registering an alarm, it may either be at a level of 6.1 volts (ratio = 1) or more for free convection or 2.2 volts (ratio = 0.360) for flow through situations. A switch 65 is indicated which is open for a free convection unit and by means of an associated resistive network provides 2.2 volts (ratio = 0.360) for a flow through unit.

Thus, in normal operation the reference signal is applied to a comparator 70 and compared to the smoke signal on line 67 to actuate the FET 72 (if the smoke signal is greater) and thus provide a light alarm at 73. Comparator 70 can also be regarded as threshhold means responsive to the smoke detector signal on line 67 to suppress any signal due to reflected light, in the absence of smoke, caused by the reflector screw 22. As discussed above, this voltage is typically 0.7 volts and is of course too low to actuate the comparator 70 when compared to 6.1 volts (or 2.2 volts).

For the main smoke detection operation of the present invention, the reference channel is set by means of gain control 71 to a certain reference output, nominally 6.1 volts (with respect to TP3), and then if the smoke signal output on line 67 exceeds that alarm level, comparator 70 will activate the alarm. Comparators 86 and 77 are operable only during the so-called test function as implemented at input 78. Comparator 76 continuously monitors the reference voltage level and disables the alarm by grounding the gate of FET 72 when the reference level falls below 3 volts.

Push button 13 grounds 78 to turn off the open collector output of a transistor of comparator 86 which allows the gate input to FET 83 to go high, thus turning it on. Specifically comparator 76 has one input connected to the reference line 68 and the other to a 3 volt source to thus inhibit an alarm output if the reference falls below its set 6.1 volt level to 3 volts or less. Comparator 77 has one terminal connected to the smoke signal output 67 and compares a tapped off 1.2 (ratio = 0.20) volt voltage (via resistor 85) from the reference signal line 68 to determine if the signal on the smoke signal line 67 (which is typically 0.7 volts as set by the smoke reflector screw 22) has exceeded a 1.2 volt limit. If so, the output goes high to turn on an FET 85 at a 5Hz rate (produced by oscillator 84), which then drives FET 83. When FET 83 is conducting, line 79 is reduced from 6.1 to 0.5 volts. However, this is referred to a common, TP3, which is set at +2.5V.

Lastly, comparator 70 in the test mode functions with an output from FET 83 input on line 79 from the test circuit to compare whether the 0.7 volt smoke reflector voltage threshhold has fallen below 0.5 volts. The test circuit includes the test input 78, comparator 86, FETs 83 and 85 and 5 Hz modulator 84.

In summary, the various alarm conditions are as follows: in a non-test state (wherein the test push button is not depressed) an alarm will occur if the level on the smoke signal line 67 is greater than that on the reference signal line 68. Thus, as indicated in FIG. 7A, this would be if the alarm level of 6.1 volts (ratio = 1) was exceeded. Then, in the test mode (with button 13 depressed) there are three different conditions. If the unit is functioning normally, the alarm light will be on; if the level on smoke signal line 67 is greater than 0.5 volts but less than 1.2 volts (see comparators 70 and 77), this is "test OK" (normal functioning)—FIG. 7A. However, a flashing marginal condition will be indicated as provided by comparator 77 if the signal on line 67 is above 1.2 volts but still less than 6.1 volts (see "OK flash"—FIG. 7A). This is considered a usable but service undesirable condition. Such a unit is more sensitive to smoke than normal—perhaps because of dust in the smoke chamber.

The next condition is that if the test button is pressed but there is no light signal or alarm indication, a repair is necessary at the time because it is a faulty unit. This will occur if the reference line 68 is less than 3 volts (see comparator 76) or if the smoke signal 67 is less than 0.5 volts (see comparator 70) (see "Fail"—FIG. 7A).

From the foregoing it is quite apparent that the 0.7 volts provided by the reflector screw is crucial in providing for a test indication which is versatile and accurate, representing the many different possible fault states of the smoke detector.

In order to calibrate a particular unit to perform with the proper voltages, referring to FIG. 6, the synthetic smoke unit may be utilized (or a UL 268 type smoke test chamber). The following steps are necessary:

With the unit in the assembled state shown in FIG. 5 with the smoke chamber 21 present, the reference signal on line 68 is set by means of gain unit 71 to 6.1 volts. This is the level at which a smoke alarm signal is desired.

Next, the smoke signal level from the light sensing smoke photodiode 24 is set via gain unit 69 to 0.7 volts. This voltage is of course caused by the light reflection from the adjustment screw. At this point the adjustment screw or pin 22 must be proximate to the beam path.

Next, as shown in FIG. 6, the synthetic smoke unit is added (or the UL 268 unit used) and the output signal of the smoke photodiode 24 is adjusted by gain unit 69 to just provide an alarm. This means its output on line 67 is somewhat larger than 6.1 volts.

Next, the synthetic smoke unit is removed, and the adjustment screw 22 is adjusted to again provide 0.7 volts which is sensed at test point 1.

The above two steps are repeated until the 6.1 and 0.7 volt levels are reached.

Lastly, the entire smoke detector unit is reassembled.

Referring to FIG. 7A, the foregoing provides the lower level of 0.7 volts and the upper alarm level of 6.1 volts. The 1. 2 volt level is built in by variable resistor 80. As also illustrated by FIG. 7A, the adjustment of the gain control 69 varies the slope of the line designated 69' which is actually the gain of the smoke detector amplifier 62.

In summary, by the use of the reflector screw 22 a measure of sensitivity in the chamber itself of the smoke detector unit is provided which, in combination with the test system, allows for accurate sensing of marginal or fault conditions remotely on the panel of FIG. 1 which is in the cockpit of an airplane far away from the smoke detectors. In addition, the manual test and visual monitoring can be supplemented or replaced by a microprocessor type system. In addition, by the use of a separate reference channel, a two-channel instrument is provided where a ratio is compared, one channel detecting the presence of smoke with the second channel serving as a reference. This reliably compensates for dust, moisture, temperature changes and aging. And as is clear from FIG. 7, the reference channel works very effectively to implement the test procedure.

We claim:

1. A light-scatter smoke detector system having a light source with a light beam path and a light sensor, both positioned within a chamber to detect light scattered from said beam path by smoke particles within the chamber, and thereby produce an alarm signal, the light sensor being positioned away from the beam path, said system comprising:

adjustable light reflector means including a pointed element proximate to said beam path for reflecting light to said light sensor; alarm means responsive to the intensity of light received by said light sensor exceeding a first threshold for producing said alarm signal; testing means responsive to said reflected light from said reflector means received by said light sensor for indicating if the amount of reflected light is lower than a second threshold or higher than a third threshold which is less than said first threshold.

2. A system as in claim 1, where said testing means has an initiator portion remote from said chamber of said testing means, which when actuated causes a said alarm signal, to indicate normal functioning.

3. A system as in claim 2 wherein said normal functioning is a range substantially from said first threshold to said second threshold.

4. A system as in claim 3 where said alarm signal includes a light and including means for flashing said light during actuation of said testing means for indicating normal but marginal functioning.

5. A system as in claim 4 where said flashing means includes comparison means responsive to a signal less than said first threshold but greater than said third threshold.

6. A system as in claim 2 where said initiator portion remote from said chamber includes a test switch manually operable by the human operator of the system.

7. A system as in claim 1, including reference means having a signal related to the intensity of light in said light beam path, and means for comparing said reference signal with a signal from said light sensor to provide said alarm signal.

8. A system as in claim 7 where said reference means includes photodiode means and includes means for diverting a fraction of said beam path light to said photodiode means.

9. A system as in claim 7 including variable gain amplifier means for providing a said reference signal with a magnitude related to a magnitude of said signal from said light sensor at a predetermined alarm level.

10. A system as in claim 1 where said light reflector means is adjusted to provide a predetermined minimum signal from said light sensor which is substantially midway between said second and third thresholds.

11. A system as in claim 10 where said system includes reference means having a signal related to the intensity of the light in the light beam path, and said system also includes smoke means for simulating smoke in said chamber and including the following steps for adjusting the light reflector means to provide said predetermined minimum signal:

a. Setting the reference signal to a level at which a smoke alarm signal is desired;

b. Setting the signal level from the light sensor to substantially said predetermined minimum;

c. Adding the smoke means and adjusting the output signal of the light sensor to provide an alarm signal whereby said adjustment is just slightly above the reference signal; and d. After removing the smoke means, adjusting the light reflector means to the said predetermined minimum signal.

e. And repeating steps c) and d) until the said desired values of both said alarm and minimum signals are reached.

12. A system as in claim 11 where said settings of steps (a) and (b) and said adjustment of step (c) are done by variable amplifier means.

* * * * *